US008054268B2

(12) United States Patent
Chen et al.

(10) Patent No.: US 8,054,268 B2
(45) Date of Patent: Nov. 8, 2011

(54) LIQUID CRYSTAL DISPLAY DEVICE HAVING PAIRS OF COMPENSATING GRADATIONS AND METHOD FOR DRIVING SAME

(75) Inventors: Eddy Giing-Lii Chen, Miao-Li (TW); Sz-Hsiao Chen, Miao-Li (TW)

(73) Assignee: Chimei Innolux Corporation, Miao-Li County (TW)

( * ) Notice: Subject to any disclaimer, the term of this patent is extended or adjusted under 35 U.S.C. 154(b) by 762 days.

(21) Appl. No.: 12/154,836

(22) Filed: May 27, 2008

(65) Prior Publication Data

US 2009/0002360 A1 Jan. 1, 2009

(30) Foreign Application Priority Data

May 25, 2007 (CN) ..... 2007 1 0074614

(51) Int. Cl.
*G09G 3/36* (2006.01)

(52) U.S. Cl. ..... 345/89; 345/690

(58) Field of Classification Search ..... 345/690, 345/89

See application file for complete search history.

(56) References Cited

U.S. PATENT DOCUMENTS 6,624,800 B2 9/2003 Hughes et al.
7,173,599 B2 2/2007 Nishimura
2003/0146882 A1* 8/2003 Ogino et al. ..... 345/1.1
2003/0193515 A1* 10/2003 Hill et al. ..... 345/695
2005/0122287 A1* 6/2005 Nishitani et al. ..... 345/63
2006/0265643 A1* 11/2006 Saft et al. ..... 715/517

FOREIGN PATENT DOCUMENTS

CN 1815314 A 8/2006
TW 582002 B 4/2004

* cited by examiner

*Primary Examiner* — Chanh Nguyen
*Assistant Examiner* — Long Pham
(74) *Attorney, Agent, or Firm* — Altis Law Group, Inc.

(57) ABSTRACT

An exemplary LCD includes a frame memory configured for receiving a plurality of first gradations of current frame and outputting a plurality of second gradations of preceding frame pre-stored therein; a comparator configured for receiving, comparing the first gradations with the second gradation to generate a comparison result; a luminance detector configured for detecting a luminance degree of each of pixel according to the gradations of current frame; a calculator configured for calculating a complication degree of a picture to be displayed in current frame; and a gradation processor configured for receiving the first gradations of current frame to be displayed on the LCD panel, generating a plurality of pairs of compensating gradations according to the gradation of each pixel, and selecting one pair of the compensating gradations to be outputted to the LCD panel according to a received comparison result, a received luminance degree, and a received complication degree.

19 Claims, 4 Drawing Sheets

| comparing result | luminance | complicated degree | compensating gradation |
|---|---|---|---|
| equal | | | compensating gradation 1 |
| | level 1 | level 1 | compensating gradation (X+1) |
| | | level 2 | compensating gradation (X+2) |
| | | ..... | ..... |
| | | level Y-1 | compensating gradation (X+Y-1) |
| | | level Y | compensating gradation (X+Y) |
| | | | |
| | level 2 | level 1 | compensating gradation X |
| | | level 2 | compensating gradation (X-1) |
| | | ..... | ..... |
| | | level Y-1 | compensating gradation (X+Y-2) |
| | | level Y | compensating gradation (X+Y-1) |
| | ⋮ | ⋮ | ⋮ |
| | level X-1 | level 1 | compensating gradation 3 |
| | | level 2 | compensating gradation 4 |
| | | ..... | ..... |
| | | level Y-1 | compensating gradation (Y+1) |
| | | level Y | compensating gradation (Y+2) |
| | | | |
| | level X | level 1 | compensating gradation 2 |
| | | level 2 | compensating gradation 3 |
| | | ..... | ..... |
| | | level Y-1 | compensating gradation Y |
| | | level Y | compensating gradation (Y+1) |

FIG. 2

LIQUID CRYSTAL DISPLAY DEVICE HAVING PAIRS OF COMPENSATING GRADATIONS AND METHOD FOR DRIVING SAME

FIELD OF THE INVENTION

The present invention relates to a liquid crystal display (LCD) device configured to reduce image aberrations, and a method for driving such kind of LCD.

GENERAL BACKGROUND

Because typical LCD devices have the advantages of portability, low power consumption, and low radiation, they have been widely used in various portable information products such as notebooks, personal digital assistants (PDAs), video cameras, and the like. Furthermore, LCD devices are considered by many to have the potential to completely replace CRT (cathode ray tube) monitors and televisions. On the other hand, the display mode of typical LCD devices is hold-type, and the response speed of liquid crystal molecules employed in such LCD devices may be too slow. As a result, the residual image phenomenon may occur when motion pictures are displayed on LCD devices.

In order to solve the above-described problems, a typical method employed for eliminating the residual image of LCD devices is the so-called black image insertion method. In the black image insertion method, a frame is divided into a first sub-frame for displaying the actual image and a second sub-frame for displaying a black image. However, because a black image is displayed between every two actual images, a viewer may easily perceive a flicker phenomenon. Furthermore, because a black image is displayed in each second sub-frame, the brightness of the images displayed by the LCD device is correspondingly reduced.

Referring to FIG. 4, a typical LCD 1 configured for eliminating the above-described problems of flicker and low brightness is shown. The LCD 1 includes a driving circuit 10 and an LCD panel 14. The driving circuit 10 includes a frame memory 11, a comparator 12, and a gradation processor 13. The frame memory 11 has a plurality of gradations V(m) of a number m ($0 \leqq m \leqq 59$, m is a natural number) frame prestored therein. The frame memory 11 provides the gradations V(m) of the number m frame to the comparator 12. After the gradations V(m) are provided to the comparator 12, the frame memory 11 receives a plurality of gradations V(m+1) of a number m+1 frame and stores the gradations V(m+1) therein.

It is assumed that the LCD panel 14 of the LCD 1 has a resolution of (I, J). In other words, the LCD panel 14 includes a pixel matrix including I (I is a natural number) rows and J (J is a natural number) columns. The gradations V(m) include a plurality of gradations V(m, i, j) corresponding to the pixel matrix of the LCD 1, each gradation V(m, i, j) represents a gradation of a number m frame to be provided to a pixel(i, j) located in a number i ($1 \leqq i \leqq I$) row and in a number j ($1 \leqq j \leqq J$) column of the pixel matrix. The gradations V(m+1) include a plurality of gradations V(m+1, i, j) corresponding to the pixel matrix, wherein each gradation V(m+1, i, j) represents another gradation of a number m+1 frame to be provided to the same pixel(i, j) of the pixel matrix.

The comparator 12 receives the gradations V(m) of the number m frame and the gradations V(m+1) of the number m+1 frame, compares the gradations V(m, i, j) with the gradations V(m+1, i, j), and provides a comparison result to the gradation processor 13.

The gradation processor 13 receives the gradations V(m+1) of the number m+1 frame that are prepared to be displayed on the LCD panel 14, and generates two pairs of compensating gradations according to the gradation V(m+1, i, j) of each pixel. Each pair of compensating gradations includes a primary compensating gradation "A" and a secondary compensating gradation "B". The gradation processor 13 selects one of the pairs of compensating gradations according to the received comparison result, and then provides the primary compensating gradation "A" of the selected pair of compensating gradations to the LCD panel 14 in an earlier period of the m+1 frame, and provides the secondary compensating gradation "B" of the selected pair of compensating gradations to the LCD panel 14 in a later period of the m+1 frame.

Referring to FIG. 5, is a graph of luminance versus time, showing two luminance curves for the LCD of FIG. 4. Corresponding to each pixel(i, j), the primary compensating gradation 1A and the secondary compensating gradation 1B are respectively equal to the gradation V(m+1, i, j) in the earlier period of a frame and in the later period of the frame. In addition, the primary compensating gradation 2A is greater than the gradation V(m+1, i, j), and the secondary compensating gradation 2B is less than the gradation V(m+1, i, j). An average value of the primary compensating gradation 2A and the secondary compensating gradation 2B is equal to the gradation V(m+1, i, j).

A driving method for the LCD 1 includes the following steps:

step a. providing a plurality of gradations V(m+1) of a number m+1 frame respectively to the frame memory 11 and the comparator 12, and at the same time, providing all the gradations V(m) of the number m frame to the comparator 12 from the frame memory 11;

step b. comparing the gradations V(m, i, j) with the gradations V(m+1, 1, j) respectively corresponding to each pixel by the comparator 12, and providing a comparison result to the gradation processor 13;

step c. when V(m, i, j)=V(m+1, i, j)—in other words, the pixel(i, j) in a number i row and in a number j column displays a still picture in the number m+1 frame—the gradation processor 13 provides the primary compensating gradation 1A to the LCD panel 14 in the earlier period of the number m+1 frame, and provides the secondary compensating gradation 1B to the LCD panel 14 in the later period of the number m+1 frame. When V(m, i, j)≠V(m+1, i, j)—in other words, the pixel(i, j) displays a moving picture in the number m+1 frame—the gradation processor 13 provides the primary compensating gradation 2A to the LCD panel 14 in the earlier period of the number m+1 frame, and provides the secondary compensating gradation 2B to the LCD panel 14 in the later period of the number m+1 frame.

Because the average value of the primary compensating gradation "A" and the secondary compensating gradation "B" is equal to the gradation V(m+1) of the number m+1 frame, the luminance of each pixel of the LCD panel 14 can be maintained to correspond with the input image data. However, when a moving picture is displayed on the LCD panel 14, the primary compensating gradation 2A and the secondary compensating gradation 2B are provided to the LCD panel 14, and a bright picture and a dim picture are sequentially displayed on the LCD panel 14. Thus a viewer may easily perceive flicker of images displayed on the LCD panel 14.

It is desired to provide a new LCD which can overcome the above-described deficiencies. It is also desired to provide a method for driving such LCD.

SUMMARY

In one preferred embodiment, an LCD includes an LCD panel, the LCD includes a frame memory configured for receiving a plurality of first gradations of a current frame to be displayed and outputting a plurality of second gradations of a preceding frame pre-stored therein; a comparator configured for receiving the first gradations of the current frame and the second gradations of the preceding frame, and comparing the first gradations with the second gradations to generate a comparison result; a luminance detector configured for detecting a luminance degree of each of pixels of the LCD panel to be displayed in the current frame according to the gradations of the current frame; a calculator configured for calculating a degree of complication of a picture to be displayed in the current frame; and a gradation processor configured for receiving the first gradations of the current frame to be displayed on the LCD panel, generating a plurality of pairs of compensating gradations according to the first gradation of each pixel, and selecting one pair of the compensating gradations to be outputted to the LCD panel according to the comparison result, a received luminance degree, and the complication degree; wherein the calculator is further configured for providing the complication degree to the gradation processor.

Other novel features and advantages will become more apparent from the following detailed description when taken in conjunction with the accompanying drawings.

BRIEF DESCRIPTION OF THE DRAWINGS

FIG. 2 is an abbreviated relationship table utilized in the LCD of FIG. 1, the relationship table including a plurality of pairs of compensating gradations.

DETAILED DESCRIPTION OF PREFERRED EMBODIMENTS

Reference will now be made to the drawings to describe various embodiments of the present invention in detail.

Figure 1:
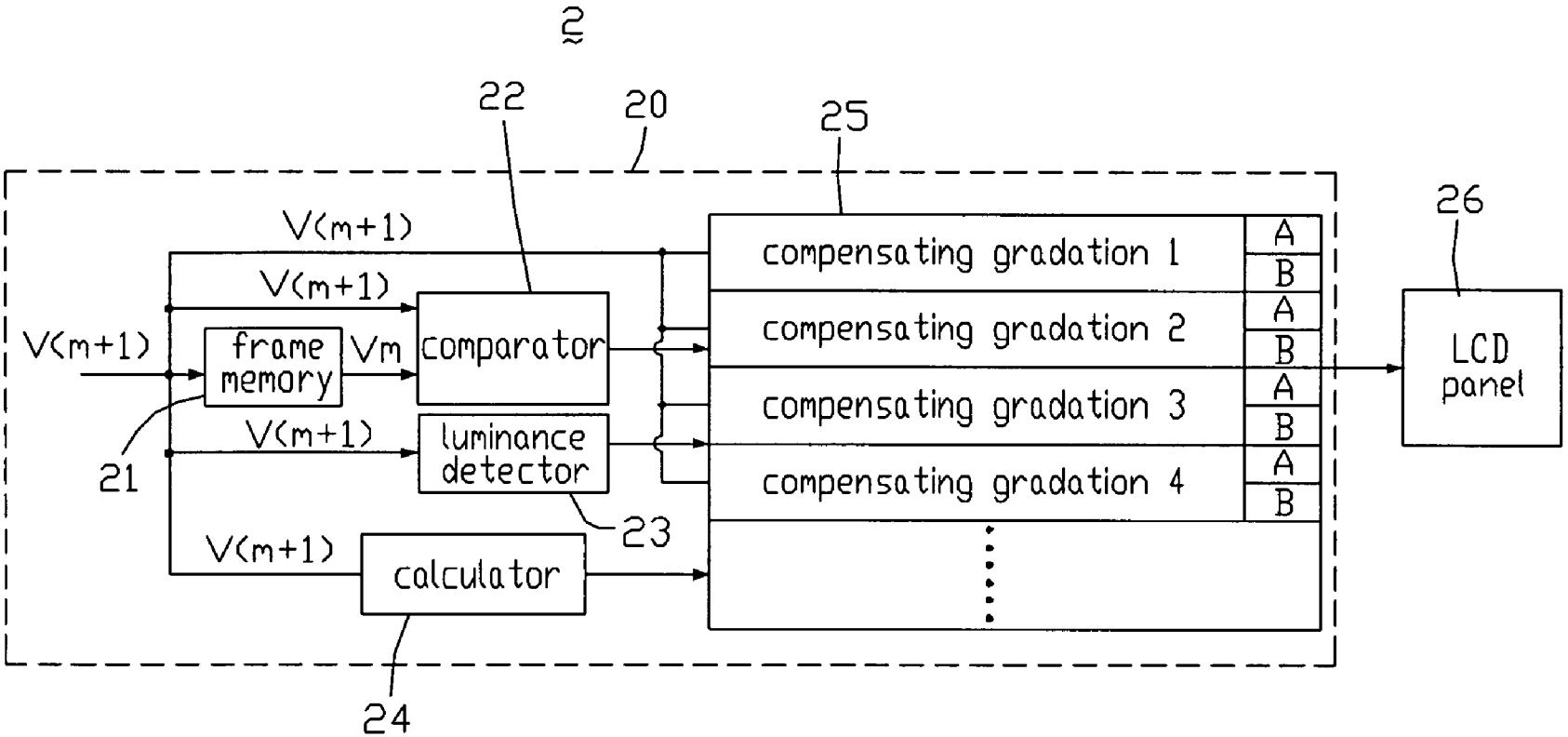
FIG. 1 is an abbreviated block diagram of certain components of an LCD according to an exemplary embodiment of the present invention, the LCD including a pixel matrix capable of displaying a plurality of pixels.

Referring to FIG. 1, an LCD 2 according to an exemplary embodiment of the present invention is shown. The LCD 2 includes an LCD panel 26 and a driving circuit 20 for driving the LCD panel 26. The driving circuit 20 includes a frame memory 21, a comparator 22, a luminance detector 23, a calculator 24, and a gradation processor 25. The LCD panel 26 includes a pixel matrix.

The frame memory 21 has a plurality of gradations V(m) of a number m ($0 \leqq m \leqq 59$, m is a natural number) frame pre-stored therein. The frame memory 21 receives a plurality of gradations V(m+1) of a number m+1 frame, and provides the gradations V(m) to the comparator 22.

The luminance detector 23 is configured for detecting a degree of luminance (hereinafter, "luminance degree") of each pixel of the pixel matrix of the LCD panel 26 in the number m+1 frame.

It is assumed that the LCD panel 26 has a resolution of 1024×768. In other words, the pixel matrix of the LCD panel 26 includes pixels arranged in 1024 columns and 768 rows. The LCD panel 26 is defined to include 64 display areas. Each display area is defined by a sub pixel matrix having 12 rows and 16 columns of pixels. The gradations V(m) includes a plurality of gradations V(m, i, j) corresponding to the pixel matrix of the LCD 2. Each gradation V(m, i, j) is provided to a pixel(i, j) located in a number i ($1 \leqq i \leqq 768$) row and in a number j ($1 \leqq j \leqq 1024$) column of the pixel matrix in the number m frame.

The calculator 22 calculates a degree of complication (hereinafter, "complication degree") of a picture to be displayed on each display area in the number m+1 frame, and provides the complication degree to the gradation processor 25. The complication degree can be calculated by summing up gradations V(m+1) of the number m+1 frame to be provided to each sub pixel matrix.

The comparator 22 receives the gradations V(m) of the number m frame and the gradation V(m+1) of the number m+1 frame, compares the gradations V(m, i, j) with the gradations V(m+1, i, j) corresponding to each pixel, and provides a comparison result to the gradation processor 25.

The gradation processor 25 receives the gradations V(m+1) of the number m+1 frame, and generates a plurality of pairs of compensating gradations according to the gradation V(m+1, i, j) of each pixel. Each pair of compensating gradations includes a primary compensating gradation "A" and a secondary compensating gradation "B". The gradation processor 25 selects one of the pairs of the compensating gradations according to the comparison result, a degree of luminance of each pixel in the number m+1 frame, and the complication degree of the picture to be displayed on the sub pixel matrix having the pixel in the number m+1 frame, and then provides the primary compensating gradation "A" of the selected pair of compensating gradations to the LCD panel 26 in an earlier period of the number m+1 frame, and provides the secondary compensating gradation "B" of the selected pair of compensating gradations to the LCD panel 26 in a later period of the number m+1 frame. An average value of the primary compensating gradation "A" and the secondary compensating gradation "B" of each pair of compensating gradations is equal to the gradation V(m+1, i, j).

Referring to FIG. 2, this is a relationship table showing relations between the comparison results of a pixel(i, j), the luminance degrees of the pixel(i, j) in the number m+1 frame, the complication degree of a picture displayed on the sub pixel matrix including the pixel (i, j) in the number m+1 frame, and the plurality of pairs of compensating gradations. The luminance degree of each pixel(i, j) is divided into X($2 \leqq X$) levels. The complication degrees of a picture displayed on the sub pixel matrix are divided into Y ($2 \leqq Y$) levels. The amount of the pairs of compensating gradations is equal to X+Y. The higher the level of the luminance degree, the brighter the pixel. The higher the level of the compensating gradation is, the more complicated the picture displayed on the sub pixel matrix including the pixel is.

Figure 3:
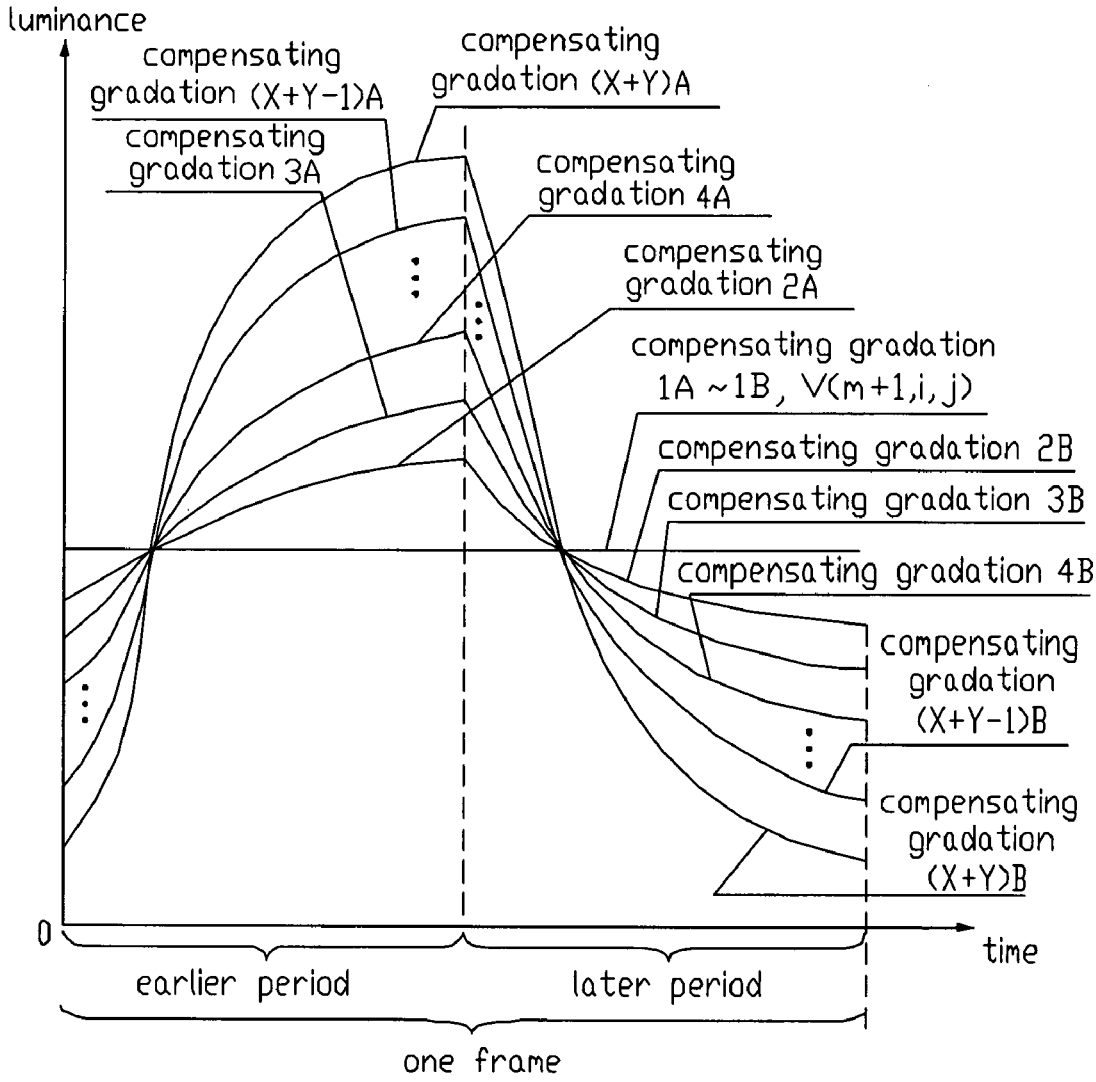
FIG. 3 is a graph of luminance versus time, showing several of a plurality of luminance curves, each luminance curve depicting one of the pairs of compensating gradations of the relationship table of FIG. 2.
Figure 4:
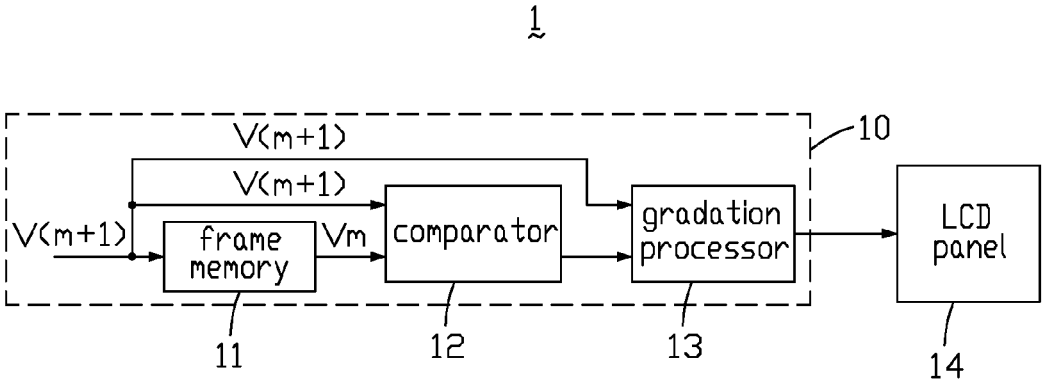
FIG. 4 (PRIOR ART)
FIG. 4 is a block diagram of certain components of a conventional LCD that is configured for eliminating flicker and low brightness, the LCD including an LCD panel.
Figure 5:
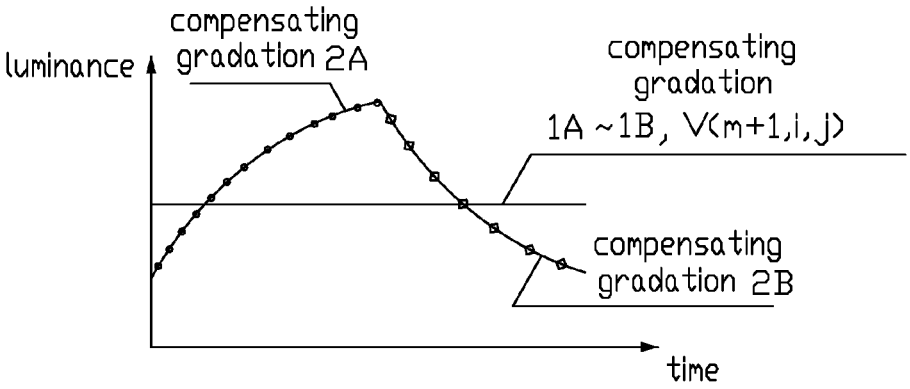
FIG. 5 (PRIOR ART)
FIG. 5 is a graph of luminance versus time, showing two luminance curves for the LCD of FIG. 4, each luminance curve depicting one of two pairs of compensating gradations provided to the LCD panel of the LCD.

Referring to FIG. 3, this shows several of a plurality of luminance curves, each luminance curve depicting one of the pairs of compensating gradations of the relationship table. The plurality of pairs of compensating gradations includes a number 1 pair of compensating gradations, a number 2 pair of compensating gradations, . . . , and so on through to a number X+Y pair of compensating gradations, with the succeeding pairs of compensating gradations having gradually increasing amplitudes. The primary compensating gradation 1A and the secondary compensating gradation 1B of the number 1 pair of compensating gradations are respectively equal to the gradations V(m+1, i, j) in the earlier period of the number m+1 frame and in the later period of the number m+1 frame. The primary compensating gradations 2A~(X+Y)A are greater than the gradation V(m+1, i, j), and the secondary compensating gradations 2B~(X+Y)B are less than the gradation V(m+1, i, j). An average value of the primary compensating gradation 2A~(X+Y)A and the secondary compensating gradation 2B~(X+Y)B of each pair of compensating gradations is equal to the gradation V(m+1, i, j).

An exemplary method for driving the LCD 2 includes the following steps:

step a. providing a plurality of gradations V(m+1) of the number m+1 frame respectively to the frame memory 21, the comparator 22, the luminance detector 23, the calculator 24, and the gradation processor 25, and at the same time, providing all the gradations V(m) of the number m frame to the comparator 22 from the frame memory 21.

step b. comparing the gradations V(m, i, j) with the gradations V(m+1, i, j) corresponding to each pixel(i, j) by the comparator 22, and providing a comparison result to the gradation processor 25, and at the same time, providing a level of luminance degree to the gradation processor 25 by the luminance detector 23, and at the same time, providing a level of the complication degree to the gradation processor 25 by the calculator 24.

step c. selecting a pair of the compensating gradations according to the comparison result, the level of the luminance degree of each of pixel, and the level of the complication degree of a picture to be displayed on the sub pixel matrix including the pixel(i, j) by the gradation processor 25, and then providing the primary compensating gradation "A" of the selected pair of compensating gradations to the LCD panel 26 in an earlier period of the number m+1 frame, and providing the secondary compensating gradation "B" of the selected pair of compensating gradations to the LCD panel 26 in a later period of the number m+1 frame.

A typical method for selecting one of the pairs of the compensating gradations is as follows. When V(m, i, j)=V(m+1, i, j)—in other words, the pixel(i, j) in number i row and in number j column displays a still picture in the number m+1 frame—the gradation processor 25 selects the number 1 pair of the compensating gradations, and provides the primary compensating gradation 1A to the LCD panel 26 in the earlier period of the number m+1 frame, and provides the secondary compensating gradation 1B to the LCD panel 26 in the later period of the number m+1 frame. When V(m, i, j)≠V(m+1, i, j)—in other words, the pixel(i, j) displays a moving picture in the number m+1 frame—the method includes the following steps:

When the luminance degree of the pixel(i, j) is equal to level 1 which indicates the pixel(i, j) is the dimmest, and the complication degree of a picture displayed on the sub pixel matrix including the pixel(i, j) is equal to level Y which indicates that the picture displayed on the sub pixel matrix including the pixel(i, j) is the most undistinguishable, the gradation processor 25 selects a number X+Y pair of the compensating gradations, and provides the primary compensating gradation (X+Y)A of the number X+Y pair of the compensating gradations to the LCD panel 26 in the earlier period of the number m+1 frame, and provides the secondary compensating gradation (X+Y)B of the number X+Y pair of the compensating gradations to the LCD panel 26 in the later period of the number m+1 frame. An amplitude of the number X+Y pair of the compensating gradations is defined to be the greatest to make the picture displayed on the sub pixel matrix including the pixel(i, j) most indistinguishable.

When the luminance degree of the pixel(i, j) is equal to level 1, and the complication degree of a picture displayed on the sub pixel matrix including the pixel(i, j) is equal to level Y−1, the number X+Y−1 pair of the compensating gradations is selected by the gradation processor 25. The amplitude of the number X+Y pair of the compensating gradations is greater than that of the number X+Y−1 pair of the compensating gradations.

When the luminance degree of the pixel(i, j) is equal to level 1, and the complication degree of a picture displayed on the sub pixel matrix including the pixel(i, j) is equal to level 1, the number X+1 pair of the compensating gradation is selected.

When the luminance degree of the pixel(i, j) is equal to level 2, and the complication degree of a picture displayed on the sub pixel matrix including the pixel(i, j) is equal to level Y, the number X+Y−1 pair of the compensating gradation is selected.

When the luminance degree of the pixel(i, j) is equal to level 2, and the complication degree of a picture displayed on the sub pixel matrix including the pixel(i, j) is equal to level Y−1, the number X+Y−2 pair of the compensating gradation is selected.

When the luminance degree of the pixel(i, j) is equal to level 2, and the complication degree of a picture displayed on the sub pixel matrix including the pixel(i, j) is equal to level 1, the number X pair of the compensating gradation is selected.

When the luminance degree of the pixel(i, j) is equal to level X which indicates the pixel(i, j) is the brightest, and the complication degree of a picture displayed on a sub pixel matrix including the pixel(i, j) is equal to level 1, the number 2 pair of the compensating gradation is selected. An amplitude of the number 2 pair of the compensating gradation is greater than that of the number 1 pair of the compensating gradations and is less than that of the number 3 pair of the compensating gradations.

Because the LCD 2 includes the gradation processor 25 configured for generating a plurality of pairs of compensating gradation according to each gradation V(m+1, i, j), and selecting one pair of the compensating gradation according to a comparison result, a level of a luminance degree of each pixel, and a level of a complication degree of a picture displayed on a sub pixel matrix including the pixel, a flicker phenomenon and a residual image of the LCD 2 can be eliminated or at least depressed. Furthermore, an average value of the primary compensating gradation and the secondary compensating gradation of each pair of compensating gradations is equal to the gradations V(m+1, i, j), and the brightness of the LCD 2 is correspondingly not decreased.

It is to be understood, however, that even though numerous characteristics and advantages of the preferred embodiments have been set out in the foregoing description, together with details of the structures and functions of the embodiments, the disclosure is illustrative only; and that changes may be made in detail, especially in matters of arrangement of parts within the principles of present invention to the full extent indicated by the broad general meaning of the terms in which the appended claims are expressed.

What is claimed is:

1. A liquid crystal display (LCD) comprising an LCD panel, the LCD further comprising:

a frame memory configured for receiving a plurality of first gradations of a current frame to be displayed and outputting a plurality of second gradations of a preceding frame pre-stored therein;

a comparator configured for receiving the first gradations of the current frame and the second gradations of the preceding frame, and comparing the first gradations with the second gradations to generate a comparison result;

a luminance detector configured for detecting a luminance degree of each of pixels of the LCD panel displaying in the current frame according to the first gradations of the current frame, the luminance degrees of the LCD panel being divided into X levels, where X≧2 and X is a natural number;

a calculator configured for calculating a degree of complication of a picture to be displayed in the current frame, the complication degrees of displays to be displayed on the LCD panel are divided into Y levels, where Y≧2 and Y is a natural number; and a gradation processor configured for receiving the first gradations of the current frame to be displayed on the LCD panel, generating a plurality of pairs of compensating gradations according to the first gradation of each pixel, and each pair of the compensating gradations selected from X+Y pairs of compensating gradations to be outputted to a corresponding pixel of the LCD panel according to the comparison result, a received luminance degree corresponding to the pixel, and the complication degree;

wherein the calculator is further configured for providing the complication degree to the gradation processor;

wherein the LCD panel comprises a plurality of display areas defined thereof, each display area comprising a sub-pixel matrix, the complication degree being calculated by summing up gradations of the current frame to be provided to each sub-pixel matrix.

2. The LCD as claimed in claim 1, wherein the LCD panel comprises a pixel matrix arranged in 1024 columns and 768 rows.

3. The LCD as claimed in claim 2, wherein the LCD panel comprises a number 64 of the display areas defined thereof.

4. The LCD as claimed in claim 1, wherein an average value of each pair of the compensating gradations is equal to the first gradation of a corresponding pixel.

5. The LCD as claimed in claim 1, wherein each pair of the compensating gradations includes a primary compensating gradation A to be provided to the LCD panel in an earlier period of the current frame, and a secondary compensating gradation B to be provided to the LCD panel in a later period of the current frame, when the LCD displays a moving picture, the primary compensating gradation A is greater than the first gradation of a corresponding pixel and the secondary compensating gradation B is less than the first gradation of the pixel.

6. The LCD as claimed in claim 1, wherein when the LCD displays a still picture, the pair of the compensating gradations comprises a primary compensating gradation A to be provided to a corresponding pixel in an earlier period of the current frame, and a secondary compensating gradation B to be provided to the pixel in a later period of the current frame, the primary compensating gradation A being equal to the first gradation corresponding to the pixel and the secondary compensating gradation B being equal to the first gradation corresponding to the pixel.

7. The LCD as claimed in claim 1, wherein when the LCD displays a moving picture, the pair of the compensating gradations comprises a primary compensating gradation A to be provided to a corresponding pixel in an earlier period of the current frame, and a secondary compensating gradation B to be provided to the pixel in a later period of the current frame, the primary compensating gradation A being greater than the first gradation corresponding to the pixel and the secondary compensating gradation B being less than the first gradation corresponding to the pixel.

8. The LCD as claimed in claim 7, wherein when the luminance degree corresponding to the pixel provided to the gradation processor has maximum level and the complication degree provided to the gradation processor has minimum level, the pairs of compensating gradations having a minimum amplitude relative to the first gradation is selected and provided to the pixel, the minimum amplitude being not equal to 0.

9. The LCD as claimed in claim 8, wherein when the luminance degree corresponding to the pixel provided to the gradation processor has minimum level and the complication degree provided to the gradation processor has maximum level, the pairs of compensating gradations having a maximum amplitude relative to the first gradation is selected and provided to the pixel.

10. A driving method for driving a liquid crystal display (LCD) comprising an LCD panel, the method comprising:

providing a plurality of first gradations of current frame respectively to a frame memory and a comparator, a luminance detector, a calculator, and a gradation processor, at the same time, providing the second gradations of preceding frame to the comparator by the frame memory;

comparing the first gradations with the second gradations corresponding to each pixel by the comparator, and providing a comparison result to the gradation processor; at the same time, providing levels of the luminance degrees to the gradation processor by the luminance detector; and providing levels of the complication degrees to the gradation processor, wherein the luminance degrees are divided into X levels, and the complication degrees are divided into Y levels, where X≧2, Y≧2, and X and Y are natural numbers;

selecting one pair of compensating gradations from X+Y pairs of compensating gradations according to a received comparison result, a received level of a luminance degree of each pixel, and a received level of a complication degree of a picture to be displayed on the LCD panel by the gradation processor, and outputting the pair of the compensating gradations to the pixel;

wherein the LCD panel comprises a plurality of display areas defined thereof, each display area comprising a sub pixel matrix, the complication degree being calculated by summing up gradations of the current frame to be provided to each sub pixel matrix.

11. The driving method as claimed in claim 10, wherein at least one of the pairs of the compensating gradations comprises a primary compensating gradation A to be provided to the LCD panel in an earlier period of the current frame, and a secondary compensating gradation B to be provided to the LCD panel in a later period of the current frame, the primary compensating gradation A being equal to the first gradation of a corresponding pixel and the secondary compensating gradation B being equal to the first gradation of a corresponding pixel.

12. The driving method as claimed in claim 10, wherein at least one of the pairs of the compensating gradations includes a primary compensating gradation A to be provided to the LCD panel in an earlier period of the current frame, and a secondary compensating gradation B to be provided to the LCD panel in a later period of the current frame, the primary compensating gradation A is greater than the first gradation of a corresponding pixel and the secondary compensating gradation B is less than the first gradation of a corresponding pixel.

13. The driving method as claimed in claim 12, wherein when a luminance degree provided to the gradation processor has maximum level and a complication degree provided to the gradation processor has minimum level, one of the pairs of compensating gradations having a minimum amplitude is selected and provided to the LCD panel.

14. The driving method as claimed in claim 13, wherein when a luminance degree provided to the gradation processor has a minimum level and a complication degree provided to the gradation processor has a maximum level, one of the pairs of compensating gradations having a maximum amplitude is selected and provided to the LCD panel.

15. The driving method as claimed in claim 12, wherein when a luminance degree provided to the gradation processor has maximum level and a complication degree provided to the gradation processor has maximum level, one of the pairs of compensating gradations having a maximum amplitude is selected and provided to the LCD panel.

16. The driving method as claimed in claim 10, wherein when the LCD displays a still picture, the pair of the compensating gradations comprises a primary compensating gradation A to be provided to a corresponding pixel in an earlier period of the current frame, and a secondary compensating gradation B to be provided to the pixel in a later period of the current frame, the primary compensating gradation A being equal to the first gradation corresponding to the pixel and the secondary compensating gradation B being equal to the first gradation corresponding to the pixel.

17. The driving method as claimed in claim 10, wherein when the LCD displays a moving picture, the pair of the compensating gradations comprises a primary compensating gradation A to be provided to a corresponding pixel in an earlier period of the current frame, and a secondary compensating gradation B to be provided to the pixel in a later period of the current frame, the primary compensating gradation A being greater than the first gradation corresponding to the pixel and the secondary compensating gradation B being less than the first gradation corresponding to the pixel.

18. The driving method as claimed in claim 17, wherein when a luminance degree provided to the gradation processor has maximum level and a complication degree provided to the gradation processor has minimum level, the pairs of compensating gradations having a minimum amplitude relative to the first gradation is selected and provided to the pixel, the minimum amplitude being not equal to 0.

19. The driving method as claimed in claim 18, wherein when a luminance degree provided to the gradation processor has minimum level and a complication degree provided to the gradation processor has maximum level, the pairs of compensating gradations having a maximum amplitude relative to the first gradation is selected and provided to the pixel.

* * * * *